United States Patent [19]

Torigai et al.

[11] Patent Number: 4,976,636

[45] Date of Patent: Dec. 11, 1990

[54] TRIM APPARATUS FOR MARINE PROPULSION UNIT

[75] Inventors: Katsumi Torigai; Masanori Takahashi, both of Hamamatsu, Japan

[73] Assignee: Sanshin Kogyo Kabushiki Kaisha, Hamamatsu, Japan

[21] Appl. No.: 263,908

[22] Filed: Oct. 28, 1988

Related U.S. Application Data

[62] Division of Ser. No. 58,908, Jun. 5, 1987, Pat. No. 4,898,563.

[30] Foreign Application Priority Data

Jun. 6, 1986 [JP] Japan ..... 61-130045

[51] Int. Cl.[5] ..... B63H 21/26

[52] U.S. Cl. ..... 440/1; 440/53; 440/63; 440/87

[58] Field of Search ..... 440/1, 53, 61, 84, 86, 440/87; 74/480 B

[56] References Cited

U.S. PATENT DOCUMENTS

| | | | |
|---|---|---|---|
| 3,468,282 | 9/1969 | Wintercorn | 440/1 |
| 4,632,232 | 12/1986 | Kolb et al. | 74/480 B |
| 4,778,414 | 10/1988 | Taguchi | 440/1 |

*Primary Examiner*—Sherman Basinger
*Assistant Examiner*—Thomas J. Brahan
*Attorney, Agent, or Firm*—Ernest A. Beutler

[57] ABSTRACT

Several embodiments of marine outboard drives including an arrangement for automatically adjusting the trim condition of an outboard drive in response to an acceleration and/or deceleration condition of the watercraft. In the embodiments the acceleration or deceleration condition is sensed by the position of a control element. In some embodiments this control element is a single-lever throttle and transmission control, in other embodiments the element comprises a portion of the throttle linkage and in other embodiments the element comprises a portion of the spark advance mechanism of the engine.

7 Claims, 6 Drawing Sheets

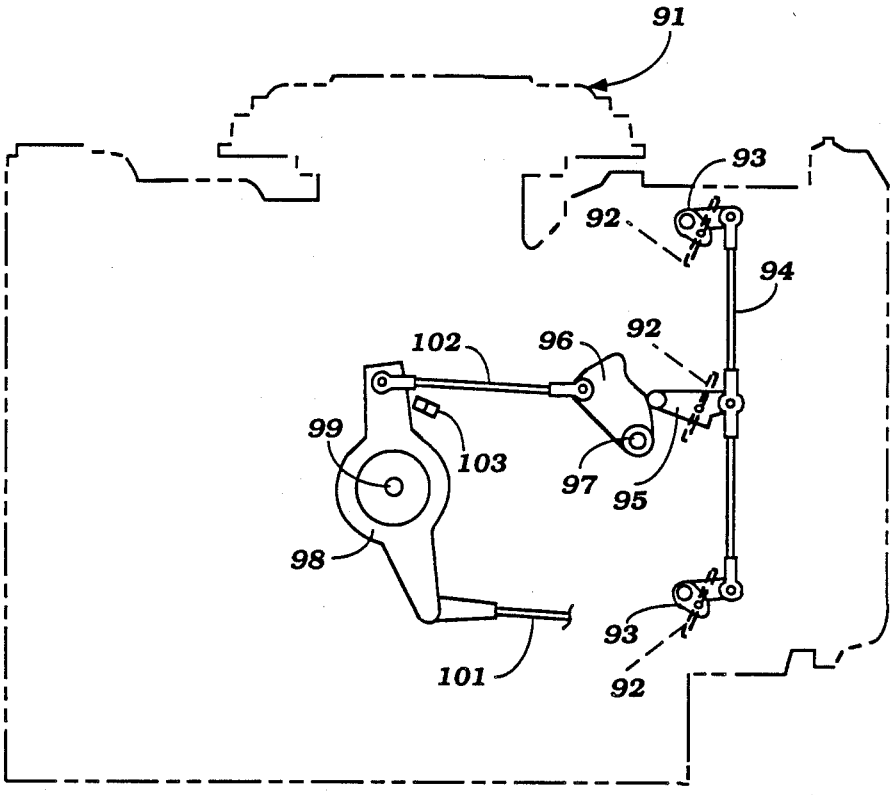
*Figure 5*
*Figure 6*
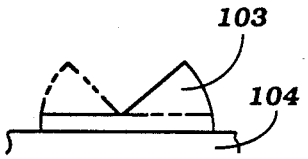

*Figure 9*
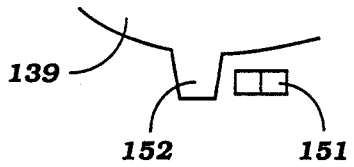
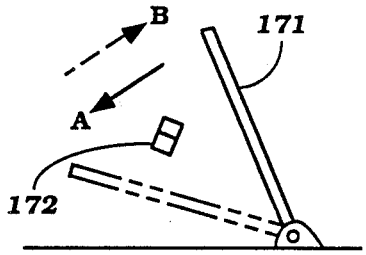
*Figure 10*
*Figure 11*
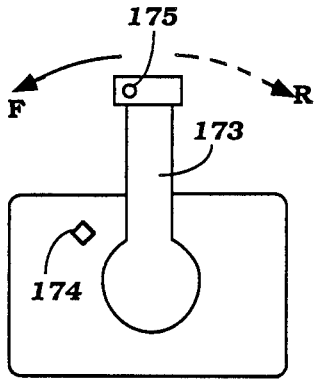

TRIM APPARATUS FOR MARINE PROPULSION UNIT

This is a division of U.S. patent application Ser. No. 058,908, filed June 5, 1987, now U.S. Pat. No. 4,898,563.

BACKGROUND OF THE INVENTION

This invention relates to a trim apparatus for a marine propulsion unit and more particularly to an improved trim control apparatus for the power trim unit of an outboard drive and to an arrangement for automatically changing the trim condition of the outboard drive in response to certain watercraft conditions.

It is a known practice to support a marine propulsion unit such as an outboard drive for movement relative to the transom of an associated watercraft between a plurality of trim adjusted positions. The optimum trim position for the outboard drive can vary depending upon a wide variety of watercraft conditions. There have been proposed fully manual trim apparatus for marine outboard drives wherein the operator can selectively control the trim position. Although such devices have certain advantages, they require the operator's full attention to the setting of the trim position of the outboard drive under all conditions. Frequently, the operator may forget to adjust the trim condition of the outboard drive to the optimum position for the selected watercraft running condition. There have also been proposed a variety of automatic trim control apparatus for marine outboard drives wherein the trim position is automatically set in response to a watercraft running condition. Although such automatic systems have the advantage of not requiring operator control, they are not fully satisfactory. One reason for this is that the watercraft running conditions may vary from instant to instant and if the automatic trim adjuster is responsive to such instantaneous changes, there will be substantial hunting in the position of the outboard drive and this is not necessary nor is it acceptable.

In order to obviate the disadvantages of the purely manual and purely automatic systems there have been proposed a variety of systems in which there is a semiautomatic operation of the outboard drive and its trim control apparatus. Semiautomatic systems permit the operator to set a predetermined trim condition for a given watercraft running condition and when the watercraft reaches that running condition the power trim apparatus is automatically operated so as to move the outboard drive to the preset position These systems have obvious advantageous. It is, therefore, a principal object of this invention to provide an improved semiautomatic trim control apparatus for a marine propulsion unit.

It is a further object of this invention to provide an improved and simplified arrangement for controlling the trim of a watercraft in response to an acceleration and/or deceleration condition.

It is a further object of this invention to provide an automatic trim control apparatus for a marine outboard drive wherein the trim condition is automatically changed when an operator moves a control element for the outboard drive.

For a wide variety of reasons it is desirable to simplify, as much as possible, the controls for an outboard drive. Specifically, it is desirable to maintain separate controls for certain of the outboard drive functions but it is also desirable to position these controls in such a manner that the operator can conveniently operate them without having to detract his attention from the other controls.

It is, therefore, a further object of this invention to provide an improved and simplified control for the trim of a marine outboard drive.

It is a further object of this invention to provide a combined control for a marine outboard drive that permits trim adjustment and another outboard drive control by means of a single-control lever.

SUMMARY OF THE INVENTION

A first feature of this invention is adapted to be embodied in a marine propulsion unit for a watercraft that comprises an outboard drive supported for pivotal movement relative to the hull of an associated watercraft between a plurality of trim adjusted positions. Power means are provided for effecting power trim adjustment of the outboard drive. A control member is incorporated that effects control of the propulsion unit other than its trim adjusted position. A control element is supported on the control member for operating the power means for adjusting the trim position of the outboard drive by the hand of an operator on the control member.

Another feature of the invention is adapted to be embodied in a marine propulsion unit comprising an outboard drive that is adapted to be supported by a transom of a watercraft for movement between a plurality of trim adjusted positions. Power means are provided for moving the outboard drive between these positions and means responsive to a predetermined condition of rate of change of speed of the watercraft operate the power means for adjusting the trim condition of the outboard drive.

Yet another feature of the invention is adapted to be embodied in a marine propulsion unit comprising an outboard drive that is adapted to be supported by a transom of a watercraft for movement between a plurality of trim adjusted positions. Power means are provided for moving the outboard drive between the trim adjusted positions. A control element is incorporated for controlling a running condition of the watercraft and means are provided for operating the power means upon movement of the control element to a predetermined position for adjusting the trim of the outboard drive.

BRIEF DESCRIPTION OF THE DRAWINGS

FIG. 5 is a side elevational view of a second embodiment of the invention.

FIG. 6 is an enlarged side elevational view of the switch in accordance with the embodiment of FIG. 5.

FIG. 9 is an enlarged top plan view of a portion of the embodiment of FIG. 8.

FIG. 10 is a side elevational view of another embodiment of the invention.

FIG. 11 is a side elevational view of a still further component of the embodiment shown in FIG. 10.

DETAILED DESCRIPTION OF THE PREFERRED EMBODIMENTS

Figure 1:
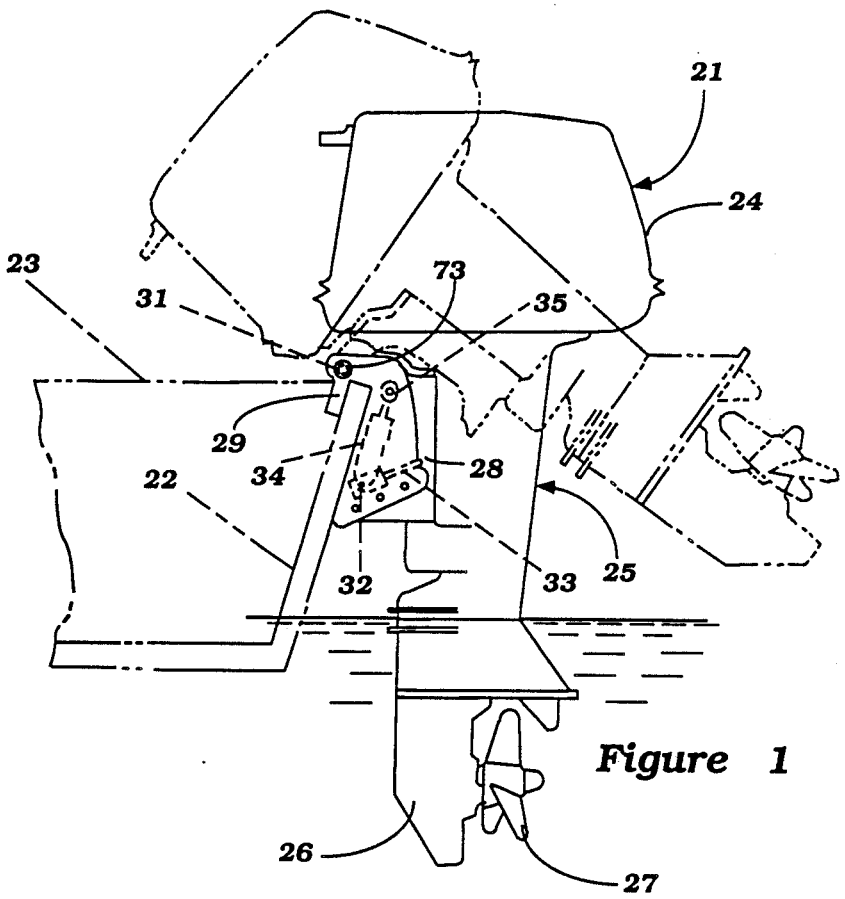
FIG. 1 is a side elevational view of a marine propulsion unit constructed in accordance with an embodiment of the invention.

Referring first to FIG. 1, a marine outboard drive constructed in accordance with a first embodiment of the invention is identified generally by the reference numeral 21. In the illustrated embodiment, the marine outboard drive 21 is comprised of an outboard motor that is attached to a transom 22 of an associated watercraft 23. Although the invention is described in conjunction with an outboard motor, it is to be understood that the term "outboard drive" is intended to encompass outboard motors as well as the outboard drive portion of an inboard/outboard arrangement. Also, the particular form of the outboard drive is exemplary only and the invention can be utilized in conjunction with a wide variety of types of outboard drives, as will be readily apparent to those skilled in the art.

In the illustrated embodiment, the outboard motor 21 is comprised of a power head 24 that includes a powering internal combustion engine and a surrounding protective cowling. The engine of the power head 24 drives a drive shaft (not shown) that is journaled within a drive shaft housing 25 that depends from the power head. A lower unit 26 is positioned beneath the drive shaft housing 25 and contains a known type of forward, neutral, reverse transmission for driving a propeller 27 by means of the drive shaft.

A steering shaft (not shown) is affixed to the drive shaft housing 25 and is journaled within a swivel bracket assembly 28 in a known manner for steering of the outboard drive 21 about a generally vertically extending axis. The swivel bracket 28 is, in turn, pivotally connected to a clamping bracket 29 by means including a horizontally disposed tilt pin 31. This pivotal connection permits adjustment of the trim position of the outboard motor 21 as well as tilting of the outboard motor 21 from a normal running position as shown in solid line view in FIG. 1 to a tilted up out of the water condition as shown in phantom in this figure. The clamping bracket 29 is affixed to the transom 22 in a known manner.

The trim and tilt positions of the outboard drive 21 are controlled by means including a hydraulically operated trim cylinder assembly 32 that is affixed to the clamping bracket 29 and which has a piston rod 33 that is engaged with the outboard drive 21 for effecting trim adjustment of the outboard drive 21 through a plurality of trim adjusted positions about the trim pivot pin 31. In addition, the hydraulic system includes a tilt fluid motor 34 that has a pivotal connection to the clamping bracket 29 and to the swivel bracket 28 by means of a pivot pin 35, for titling the outboard drive up from the uppermost trim adjusted position to a tilted up out of the water condition as shown in phantom in FIG. 1.

Figure 2:
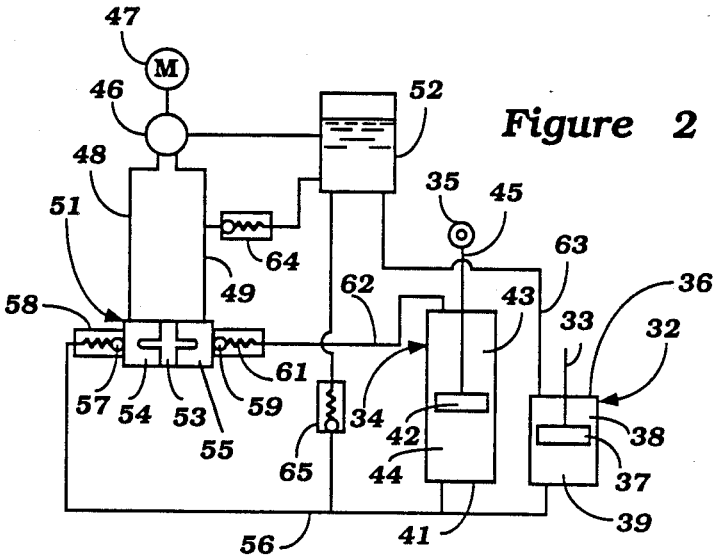
FIG. 2 is a schematic view showing the hydraulic control system for the tilt and trim adjustment of the outboard drive.

Although any known type of hydraulic system may be employed for operating the tilt fluid motor 34 and trim fluid motor 32, FIG. 2 illustrates a typical schematic of a hydraulic system that can be utilized in conjunction with the invention.

Referring now to FIG. 2, the trim fluid motor 32 includes a cylinder housing 36 which, as has been previously noted, is affixed to the clamping bracket 29 in a suitable manner. A piston 37 is slideably supported within the cylinder 36 and divides it into an upper chamber 38 and a lower chamber 39. The piston rod 33 is affixed to the piston 37 and extends through the chamber 38 and is engaged with the swivel bracket 28 when the outboard motor 21 is in the trim adjusted positions, as has been previously noted.

The tilt fluid motor 34 is also comprised of an outer cylinder housing 41. The lower end of the cylinder housing 41 has a pivotal connection to the clamping bracket 29, as aforenoted. A piston 42 is slideably supported within the cylinder housing 41 and divides it into an upper chamber 43 and a lower chamber 44. A piston rod 45 is affixed to the piston 42 and, as aforenoted, has a pivotal connection 35 to the swivel bracket 28.

The hydraulic system includes a reversible fluid pump 46 that is driven by a reversible electric motor 47. The pump 46 has a pair of ports that communicate with lines 48 and 49 that extend to a shuffle valve assembly, indicated generally by the reference numeral 51. In addition, the pump 46 communicates with a reservoir 52 in a known manner.

The shuttle valve 51 is provided with a shuttle piston 53 that divides the shuttle valve into a pair of chambers 54 and 55. The chamber 54 is adapted to communicate with a first fluid line 56 through a pressure responsive check valve 57. Check valve 57 permits flow into a chamber 58 which, in turn, communicates with the line 56.

In a similar manner, the shuttle valve chamber 55 communicates with a check valve 59 which, in turn, permits flow into a chamber 61 that communicates with a fluid line 62.

The fluid line 56 communicates with the chamber 44 of the tilt fluid motor 34 and also with the chamber 39 of the trim fluid motor 32. In a similar manner, the line 62 communicates with the chamber 43 of the tilt fluid motor 34. The chamber 38 of the trim fluid motor 32 communicates directly with the reservoir 52 through a return line 63.

A tilt down pressure relief valve 64 communicates the line 49 with the reservoir 52 for tilt down relief. Tilt up relief is provided by a pressure responsive valve 65 that communicates the line 56 with the reservoir 52.

In order to achieve either tilt or trim up operation, the electric motor 47 is energized so as to drive the fluid pump 46 in a direction so that the line 48 will be pressurized and the line 49 will function as a return line. When the line 48 is pressurized, the shuttle valve 53 will be forced to the right as seen in FIG. 2 and a projection of the shuttle piston 53 will engage the check valve 59 so as to open it. At the same time, the pressure in the chamber 54 will be sufficient to open the check valve 57 so as to communicate the chambers 54 and 58 with each other and, accordingly, to pressurize the line 56. As a result, fluid under pressure will be delivered to the trim fluid motor chamber 39 and the tilt fluid motor chamber 44 to urge the pistons 37 and 42 outwardly. This will effect pivotal movement of the outboard drive 21 in a counterclockwise direction about the pivot pin 31 so as to achieve trim up adjustment of the outboard drive.

During this operation, fluid is expelled from the trim fluid motor chamber 38 back to the reservoir 52 through the line 63. Fluid is returned from the tilt fluid motor chamber 43 through the line 62 and open check valve 59 to the shuttle valve chamber 55 for return to the inlet side of the pump through the line 49. Makeup fluid may be drawn from the reservoir 52 in the event it is required.

Once the trim fluid motor 32 reaches the end of its stroke, the piston 37 will stop against the cylinder housing 36 and further extension will be precluded. This determines the limit of the trim up adjustment of the outboard drive. Further energization of the electric motor 47 and fluid pump 46 will result in tilt up operation since only the tilt fluid motor 34 will be energized and the operation will continue as should be apparent. When tilt up operation is completed, the relief valve 65 will open in the event the fluid pump 46 is not stopped so as to prevent damage.

Tilt or trim down operation is achieved by operating the electric motor 47 and fluid pump 46 so that the line 49 is pressurized and the line 48 acts as a return line. Assuming that the outboard motor has been fully tilted up, initial pressurization of the line 49 will cause fluid to flow through the shuttle valve chamber 55 and open the check valve 59 so as to pressurize the line 62 and the tilt fluid motor chamber 43. The piston 42 will then be urged downwardly. It should be noted that during this operation the trim fluid motor 32 will be held at the outer end of its stroke since the chamber 38 is not pressurized.

When the shuttle valve chamber 55 is pressurized, the shuttle piston 53 will shift to the left and unseat the check valve 57 so as to communicate the line 56 with the pump line 48, which is now the return line. Fluid is then expelled from the trim fluid motor chamber 44 back through the line 56 to the inlet side of the pump 46. As before, any makeup fluid required can be drawn from the reservoir 52.

Once the outboard motor 21 has been tilted down sufficiently so that the swivel bracket 28 engages the piston rod 33 of the trim fluid motor 32 the fully trimmed up condition will of been reached. If the operator desires to achieve trim down operation, the electric motor 47 and fluid pump 46 are continuously energized so as to pressurize the line 49. The trim fluid motor 37 then causes the outboard motor 21 to be trimmed down and the piston 37 of the trim fluid motor 32 will be forced downwardly and fluid will be expelled from the chamber 39 back to the reservoir. The chamber 38 may refill with fluid through the makeup line 63 directly from the reservoir 52.

Once fully trimmed down position is reached, the relief valve 64 will open to prevent damage in the event the fluid pump 46 and electric motor 47 are not stopped.

As aforedescribed, the fluid circuit shown in FIG. 2 is only typical of one of many fluid circuits that can be utilized in conjunction with the invention. For that reason, further details of the construction are not believed to be necessary.

Figure 3:
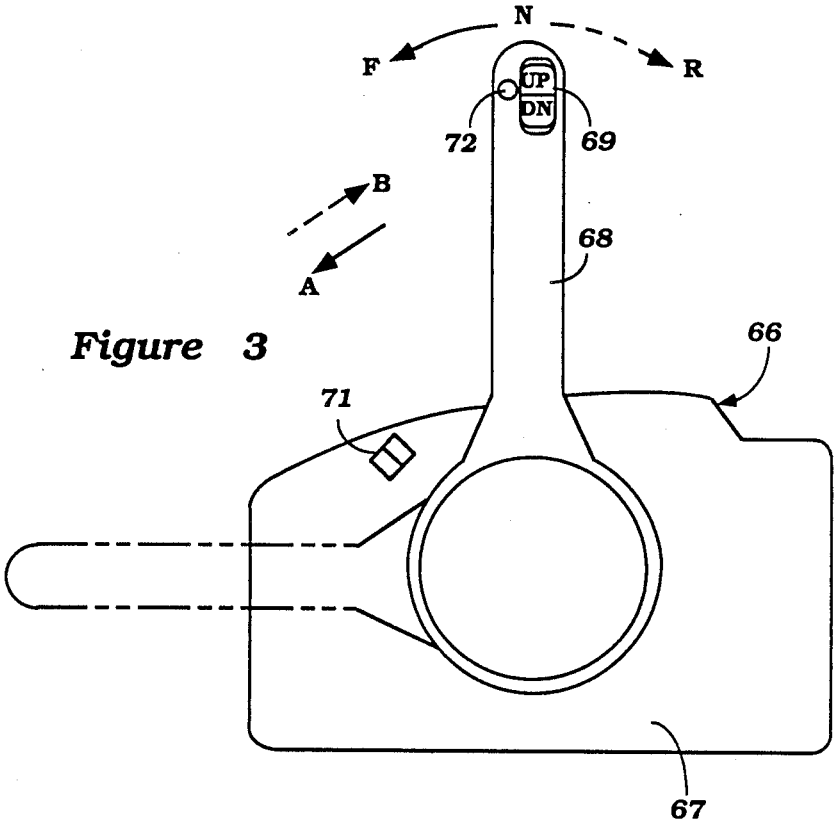
FIG. 3 is an enlarged side elevational view showing the control mechanism in accordance with this embodiment.

Referring now to FIG. 3, the control for certain functions of the outboard motor 21 and also for the tilt and trim control will be described. As has been previously noted, the outboard motor 21 includes a forward neutral reverse transmission of a known type and also an internal combustion engine. There is shown in FIG. 3 a typical single-lever control for controlling both engine speed and transmission shifting, indicated generally by the reference numeral 66. The single-lever control 66 comprises an outer housing 67 and a control lever 68 that is supported for pivotal movement. The control lever 68 is connected by means of a known type of control to both the throttle linkage for the engine of the outboard motor 21 and also the transmission. The construction is such that when the lever 68 is moved from the solid line position shown in FIG. 3 (the neutral, idle position) in a counterclockwise direction, the transmission will first be shifted into forward and then the engine will be accelerated. If the lever 58 is rotated in the clockwise direction from the position shown in FIG. 3, the transmission will first be shifted into reverse and then the engine will be accelerated. As is typical, the mechanism may be such that the speed in reverse will be significantly less than the speed in forward.

As has been previously noted, the single-lever control may be of any known type to achieve this function. Since the operation of the single-lever control in controlling engine speed and transmission shifting forms no part of the invention, this construction has not been illustrated in detail. However, in accordance with the invention it should be noted that the single-lever control lever 68 is configured so that it can be gripped by an operator's hand. Positioned at the upper end of the control lever 68 is a control switch 69 for operating the electric motor 47 in either the up or down direction so that the operator may achieve trim adjustment of the outboard drive 21 while gripping the control lever 68. As a result, there is considerable simplicity in the system. In addition, there is provided an automatic control circuit (to be described by reference to FIG. 4) that includes a position responsive switch 71 for automatically trimming up the outboard drive 21 to a preset position in response to a certain acceleration condition and for trimming down in response to a deceleration condition. This acceleration and/or deceleration condition are sensed by the movement of the lever 68 to or from a preset position determined by the location of the switch 71. Furthermore, there is provided a reset switch 72 that is juxtaposed to the up/down control switch 69 so as to permit resetting of the system as will now be described.

Figure 4:
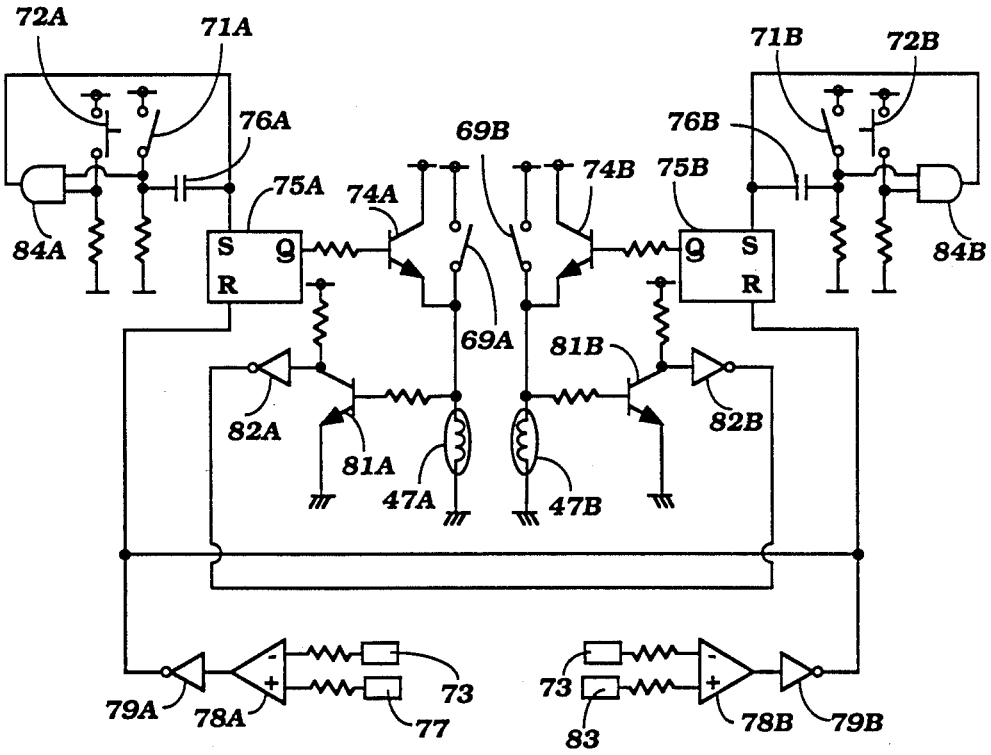
FIG. 4 is a schematic view of the electrical circuit for the control mechanism.

In FIG. 4, the control circuit is indicated schematically and the reference character A has been added as a suffix to the identifying reference numerals to indicate the components associated with the tilt/trim up operation and the suffix B added to identify those components associated with the tilt/trim down operation. Up and down windings of the electric motor 47 are indicated at 47A and 47B and are in circuit with a power source through the contacts 69A and 69B of the control switch 69 so as to energize the windings 47A or 47B depending upon whether the operator selects manual tilt/trim up or tilt/trim down operation.

The outboard motor 21 is provided with a trim position sensor 73 which may be of any known type and is depicted in FIG. 1 as being located between the clamping bracket 29 and swivel bracket 28 for indicating the angular position of the outboard motor 21 relative to the clamping bracket 29 about the pivot pin 31.

There is provided a transistor 74A in a parallel circuit between the source and the trim-up winding 47A with the manual trim-up switch 69A. The condition of the transistor 74A is switched by means of a flip-flop 75A which has its set terminal in circuit with a capacitor 76A. The capacitor 76A delivers a pulse signal to the set terminal S of the flip-flop 75A when the acceleration trim-up switch 71A is closed so as to change the state of the flip-flop 75A and switch the transistor 74A on so that it will be conductive and the winding 47A will be energized so as to achieve automatic trim up of the outboard motor 21 when the throttle lever 68 is moved into proximity with the switch 71 indicating an acceleration condition.

The trim up operation continues until the trim position indicated by the sensor 7.3 coincides with a predetermined trim up position 77 which is suitably set by the operator or which may be preset at the factory and which is compared with the actual trim condition 73 by means of a comparator 78A. When the signals are the same, an invertor 79A is excited so as to send a signal to the reset terminal R of the flip-flop 75A so as to switch the transistor 74A off and discontinue the trim up operation.

When the trim-up winding 47A is energized, a trim-up transistor 81A will be switched on so as to complete a circuit through an invertor 82A to send a signal to the trim-down flip-flop 75B so as to change its state and switch off a transistor 74B in circuit with the trim-down winding 47B so that only trim up operation will be achieved.

If the lever 68 is moved back away from proximity with the switch 71 to initiate deceleration, the switch 71A will be reopened and the switch 71B will be closed. As a result, a capacitor 76B will send a pulse output to the set terminal of the flip-flop 75B so as to set it and render the transistor 75B conductive. The trim-down winding 47B of the electric motor will be energized at this time so as to effect full trim down of the outboard motor. Full trim down condition is sensed by means of a trim down sensing switch 83 that senses the full trim down condition of the outboard motor 21. This may be done by means of a limit switch which is engaged by a component of the outboard motor 21 when it is fully trimmed down, or by detecting that the output of the trim angle sensor 73 continues to be of the same value for a period of time, or by detecting a high pressure in the trim down line 62, or upon opening of the trim down check valve 64, or by detecting a high current flow through the motor 47. Various other arrangements may be employed for sensing when the outboard motor 21 is fully trimmed down.

When the trim down condition sensor 83 coincides with the actual trim position sensor 73, a trim-down comparator 78B will energize an inverter 79B so as to reset the flip-flop 75B and discontinue the trim down operation. During trim down operation, a trim-down transistor 81B will also be switched on so as to energize an invertor 82B and reset the trim-up flip-flop 75A.

It should be noted that when the system is in automatic trim up mode and the operator desires to achieve manual trim down through closure of the switch 69B, the trim-down transistor 81B will be rendered conductive and the inverter 82B will be energized so as to effect resetting of the trim-up flip-flop 75A and discontinue the energization of the trim-up windings 75A. In a similar manner, manual trim up operation may be achieved when the system is in automatic trim down condition by operating the contact 69A of the manual trim-up switch which will switch on the trim-up transistor 81A and reset the flip-flop 75B of the trim-down circuit.

In the event the operator desires to achieve continued automatic trim up operation due to an interruption by manual trim down operation, he can merely press the reset button 72. The contact 72A will then complete a circuit to an AND gate 84A which is in circuit with the automatic trim-up switch 71A, which will still be closed, and a signal will be outputted to the set terminal of the flip-flop 75A to again cause its state to change and switch the transistor 74A on. A similar operation is possible to achieve continued automatic trim down operation if it was previously interrupted by manual trim up operation through the use of a circuit with an AND gate 84B.

In the embodiment of FIGS. 1–4, the acceleration/deceleration sensing switch 71 was positioned so as to be in proximity to the single-lever throttle and transmission control 68. It is to be understood that various other types of acceleration/deceleration sensing devices may be employed and FIGS. 5 and 6 show yet another embodiment. In this embodiment, the engine of the outboard motor is shown in phantom and is identified generally by the reference numeral 91. The engine 91 is provided with a plurality of carburetors each of which has a throttle valve 92 for controlling the speed of the associated engine. The throttle valves 92 are supported on throttle valve shafts to which throttle valve actuating levers 93 are affixed. The throttle valve actuating levers 93 are connected with each other by means of a link 94 and are connected to a main throttle valve lever 95. The throttle valve lever 95 cooperates with a cam 96 that is rotatably supported on the engine by means of a shaft 97 so that rotation of the cam 96 will effect opening and closing movement of the throttle valves 92.

A main throttle control lever 98 is rotatably supported on the engine by means of a shaft 99. The main throttle control lever 98 is actuated by means of a flexible cable 101 that is connected to a remotely positioned throttle actuator. The lever 98 has a further arm which is connected by means of a link 102 to the cam 96 for operating the cam 96 upon rotation lever 98.

In this embodiment, an acceleration/deceleration sensing switch 103 is supported on the cylinder block 104 of the engine in proximity to the lever 98 so as to be activated when the lever 98 moves to a position indicating acceleration. When the throttle valve lever 98 is not in the acceleration condition, the switch 103 will be activated to its deceleration condition as would the previously described embodiment.

Figure 7:
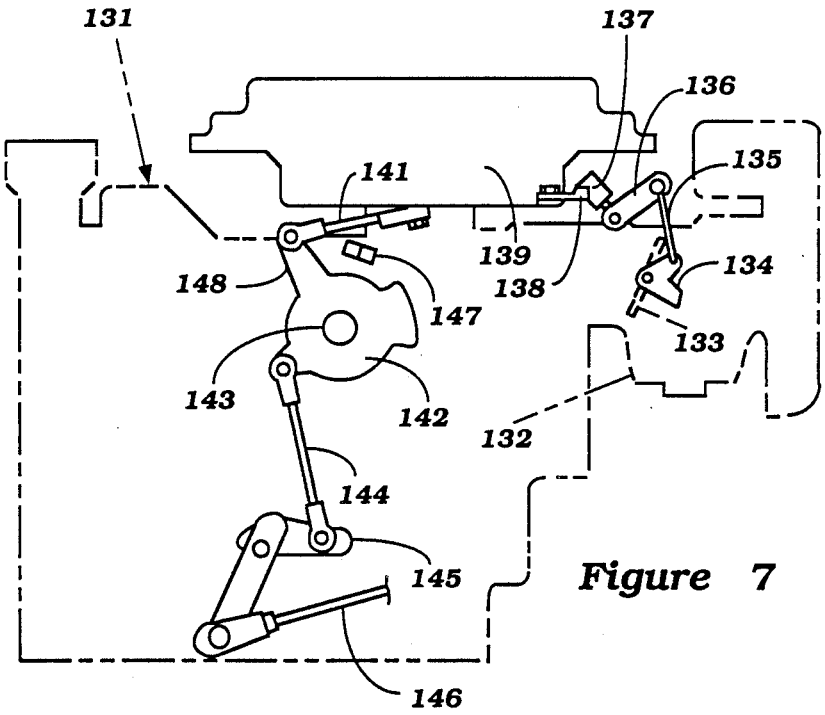
FIG. 7 is a side elevational view of another embodiment of the invention.

Another embodiment of the invention is shown in FIG. 7 and this embodiment differs from the previously described embodiments only in the location of the acceleration/deceleration sensing switch. In this embodiment, an internal combustion engine of an outboard motor is shown partially in phantom and is identified generally by the reference numeral 131. In this embodiment, the engine is provided with a carburetor 132 that has a throttle valve 133 for controlling the speed of the engine. The throttle valve 133 is affixed to a throttle valve shaft and a throttle lever 134 is affixed to the exposed end of the throttle valve shaft. The throttle valve lever 134 is connected by means of a link 135 to one arm of a bell crank 136 that is supported on the upper end of the engine. The bell crank 136 carries a cam follower 137 on its other arm which is adapted to be contacted by a cam 138 that is affixed to a timing plate 139 of the engine. The timing plate 139 is rotatably supported relative to the flywheel end of the engine 131 and carries the ignition pulser so that rotation of the timing plate 139 will change the timing events of the engine.

A link 141 is pivotally connected at one end to the timing plate 139 and at its other end to one arm of a cam 142. The cam 142 is rotatably supported on the engine by means of a pivot shaft 143.

Cam 142 is rotated by means of a link 144 that is pivotally connected between the cam 142 and one arm of a bell crank 145. The other arm of the bell crank 145 is connected to a Bowden wire cable 146 for operation by the remote operator.

When the bell crank 145 is rotated, the cam 142 will rotate and pivot the timing plate 139 so as to adjust the ignition timing of the engine. At the same time, the cam 138 will engage the follower 137 and pivot the bell crank 136 so as to open the throttle valve 133. It should be noted that this mechanism may be considered to be conventional. In accordance with this embodiment of the invention, an acceleration/deceleration sensing switch 147 is positioned in proximity to an arm 148 of the cam 142 so as to be energized upon acceleration or deceleration conditions as should be readily apparent from the foregoing description.

Figure 8:
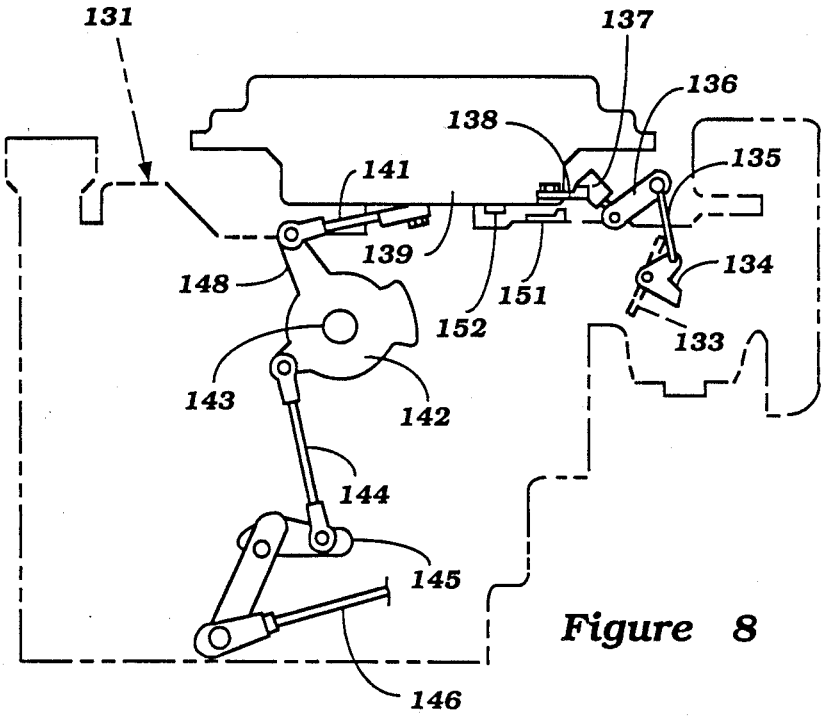
FIG. 8 is a side elevational view of a still further embodiment of the invention.

FIGS. 8 and 9 show yet another embodiment of the invention which is generally similar to the embodiment of FIG. 7 in that the throttle and spark mechanism is the same. For that reason, those components have been identified by the same reference numeral and will not be described again in detail, except insofar as is necessary to understand the construction in operation of this embodiment.

This embodiment, an acceleration/deceleration sensing switch 151 is carried by the upper portion of the engine block in proximity to the timing plate 139. The timing plate 139 is formed with projection 152 that is adapted to cooperate with the acceleration/deceleration switch 151 so as to provide acceleration/deceleration indications as would the previously described embodiments.

FIG. 10 shows yet another embodiment of the invention wherein the watercraft is provided with an accelerator pedal 171. In this embodiment, an acceleration/deceleration sensing switch 172 is juxtaposed to the accelerator pedal 171 so as to be operated by it and sense either an acceleration or deceleration condition. This embodiment, it is desirable to ensure that the trim up operation occurs only during forward operation and, for that reason, the shift control, indicated at 173 in FIG. 11, operates with a transmission condition switch 174 that is in series with the switch 172 and which will sense when the shift lever is shifted to a forward position. As with the previously described embodiments, a reset button 275 may be carried by the shift lever 173.

It should be readily apparent from the foregoing description that a number of embodiments of the invention have been illustrated and described. Each of these embodiments is effective to provide semiautomatic trim operation of a marine outboard drive in response to acceleration and/or deceleration conditions. Various acceleration/deceleration sensing mechanisms have been illustrated and described. Although a number of embodiments of the invention have been illustrated and described, various other changes and modifications may be made without departing from the spirit and scope of the invention, as defined by the appended claims.

We claim:

1. In a marine propulsion unit comprising an outboard drive adapted to be supported by a transom of a watercraft for movement between a plurality of trim adjusted positions, power means for moving said outboard drive between said positions, a control operated by an operator to effect a rate of change of speed of said watercraft, and means responsive solely to the operations of said control for operating said power means for adjusting the trim condition of said outboard drive.

2. A marine propulsion unit defined in claim 1 wherein the means responsive to the operation of the control moves the outboard drive to a preset condition in response to operation of the control.

3. A marine propulsion unit defined in claim 1 wherein the control is a throttle control.

4. A marine propulsion unit defined in claim 1 wherein the control is a spark advance.

5. A marine propulsion unit defined in claim 1 wherein the control comprises a combined speed and transmission control.

6. A marine propulsion unit defined in claim 3 wherein the means is responsive to the position of the throttle control lever.

7. A marine propulsion unit defined in claim 3 wherein the means is responsive to a change in position of a throttle linkage of the engine of the outboard drive.

* * * * *